US008267540B2

(12) United States Patent
Kluś

(10) Patent No.: US 8,267,540 B2
(45) Date of Patent: Sep. 18, 2012

(54) SPECIAL PURPOSE LED-BASED LINEAR LIGHTING APPARATUS

(76) Inventor: Sylwester Kluś, Kamionka (PL)

( * ) Notice: Subject to any disclaimer, the term of this patent is extended or adjusted under 35 U.S.C. 154(b) by 426 days.

(21) Appl. No.: 12/617,326

(22) Filed: Nov. 12, 2009

(65) Prior Publication Data

US 2011/0110077 A1 May 12, 2011

(51) Int. Cl.
*F21S 4/00* (2006.01)
*F21S 8/02* (2006.01)

(52) U.S. Cl. ..... 362/153; 362/224; 362/217.12; 362/217.16; 362/365

(58) Field of Classification Search ..... 362/147, 362/153, 153.1, 219, 223, 224, 217.1, 217.11, 362/217.12, 217.13, 217.14, 217.15, 217.16, 362/217.17, 249.02, 374, 375, 268, 364, 362/365

See application file for complete search history.

(56) References Cited

U.S. PATENT DOCUMENTS

| | | | | |
|---|---|---|---|---|
| 6,361,186 | B1 | 3/2002 | Slayden | |
| 6,561,690 | B2 | 5/2003 | Balestriero | |
| 6,585,393 | B1 | 7/2003 | Brandes et al. | |
| 6,682,205 | B2 | 1/2004 | Lin | |
| 7,048,413 | B2 | 5/2006 | Fan | |
| 7,101,056 | B2 | 9/2006 | Pare | |
| 7,159,997 | B2 | 1/2007 | Reo | |
| 7,572,027 | B2 * | 8/2009 | Zampini et al. | 362/225 |
| 7,573,055 | B2 * | 8/2009 | Palatzky et al. | 250/559.36 |
| D621,090 | S | 8/2010 | Klus | |
| D621,091 | S | 8/2010 | Klus | |
| D621,542 | S | 8/2010 | Klus | |
| D623,342 | S | 9/2010 | Klus | |
| D623,343 | S | 9/2010 | Klus | |
| D625,463 | S | 10/2010 | Klus | |
| 7,854,527 | B2 * | 12/2010 | Anderson | 362/133 |
| 7,857,482 | B2 * | 12/2010 | Reo et al. | 362/225 |
| 2006/0146531 | A1 | 7/2006 | Reo et al. | |
| 2008/0055894 | A1 | 3/2008 | Deng | |

* cited by examiner

*Primary Examiner* — Thomas Sember
(74) *Attorney, Agent, or Firm* — Mark Terry

(57) ABSTRACT

A linear lighting apparatus is disclosed. The apparatus includes an elongated element having a substantially U-shaped cross-section and an LED strip placed longitudinally along a bottom of the elongated element. The apparatus further includes a first flange located on both sides of an exterior of the elongated element and a second flange located on both sides of the exterior of the elongated element. The apparatus further includes a gutter located on both sides of an interior of the elongated element and a first optical element comprising an elongated planar element composed of optical material. The apparatus further includes a rim located on a top of both sides of the elongated element and a second optical element comprising an elongated planar element for placement on top of the horizontal surface of the rim.

19 Claims, 7 Drawing Sheets

SPECIAL PURPOSE LED-BASED LINEAR LIGHTING APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

This invention relates to the field of lighting, and more particularly to the field of LED-based special-purpose lighting.

BACKGROUND OF THE INVENTION

Various types of linear lighting apparatuses exist in the lighting industry today. Many of the latest lighting apparatuses use-light-emitting diodes ("LEDs") as light sources. LEDs are individual point light sources that deliver a singular beam of light. Conventional linear lighting apparatuses that use LEDs are usually constructed for particular purposes. For example, the lighting apparatuses may be constructed for use on ceilings for lighting a room, for use within cabinets to illuminate the contents of a drawer or for use on an exterior wall for lighting a sign.

U.S. Pat. No. 6,361,186, for example, discloses a linear lighting apparatus using LEDs wherein the lighting apparatus is constructed generally for use on walls as commercial signage. U.S. Pat. No. 6,682,205 also discloses an LED-based linear lighting apparatus constructed generally for use on walls as signage. U.S. Pat. No. 6,585,393 discloses an LED linear lighting apparatus constructed generally for use as under-cabinet lighting for the home. Lastly, U.S. Pat. Pub. No. 2006/0146531 discloses a linear lighting apparatus using LEDs wherein the lighting apparatus is constructed generally for lighting billboards or the façade of a building.

One of the problems with currently-available linear lighting apparatuses that use LEDs is the limitation on where the lighting apparatuses can be used. As explained above, most LED-based linear lighting apparatuses are built to illuminate areas of a home or building, portions of furniture such as cabinetry or simply a commercial advertisement. As such, conventional linear lighting apparatuses that use LEDs are set up to illuminate in the top-down direction or the side-to-side direction. No such LED-based linear lighting apparatuses, however, are available for lighting from the ground up. This is disadvantageous since there is a need to light floor and ground areas in such a way that illumination occurs in the bottom-up direction.

Another problem with conventional linear lighting apparatuses that use LEDs is the fragile construction of the lighting apparatuses. Since conventional linear lighting apparatuses are constructed for use in out-of-reach areas within the home or in areas that rarely come into contact with people or other objects, the housings are not built to handle heavy loads or robust strikes or jolts. This is disadvantageous as it limits the range of places where the lighting apparatuses can be used.

Therefore, there is a need to traverse the deficiencies in the art and more particularly there is a need for a more versatile and sturdy LED-based linear lighting apparatus that can be used in a wider variety of applications.

SUMMARY OF THE INVENTION

Briefly, in accordance with one embodiment of the present invention, a linear lighting apparatus is disclosed. The apparatus includes an elongated element having a substantially U-shaped cross-section comprising a first vertical sidewall, a second vertical sidewall and a horizontal floor joining the first and second sidewalls. The apparatus further includes an LED strip placed longitudinally along the horizontal floor of the elongated element and a first pair of flanges located on exterior surfaces of the first and second sidewalls, wherein the first pair of flanges is coextensive with the elongated element and coplanar with the horizontal floor. The apparatus further includes a second pair of flanges located on exterior surfaces of the first and second sidewalls, wherein the second pair of flanges is coextensive with the elongated element and parallel to the horizontal floor. The apparatus further includes a pair of gutters located on interior surfaces of the first and second sidewalls, wherein the pair of gutters is coplanar with the second pair of flanges so as to form a U-shaped protrusion on the exterior surfaces of the first and second sidewalls, thereby comprising the second pair of flanges, and wherein the pair of gutters allows for insertion of a planar element creating a friction fit between the pair of gutters and the planar element. The apparatus further includes a first optical element comprising an elongated planar element composed of optical material, wherein the first optical element is inserted into the pair of gutters so as to create a friction fit with the pair of gutters. The apparatus further includes a first rim located on a top of the first sidewall, wherein the first rim comprises a horizontal surface adjacent to a vertical surface extending upwards from the horizontal surface. The apparatus further includes a second rim located on a top of the second sidewall, wherein the second rim comprises a horizontal surface adjacent to a vertical surface extending upwards from the horizontal surface. The apparatus further includes a second optical element comprising an elongated planar element for placement on top of the horizontal surface of the first rim and the horizontal surface of the second rim, wherein both sides of the second optical element are adjacent to the vertical surface of the first rim and the vertical surface of the second rim.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

Figure 1:
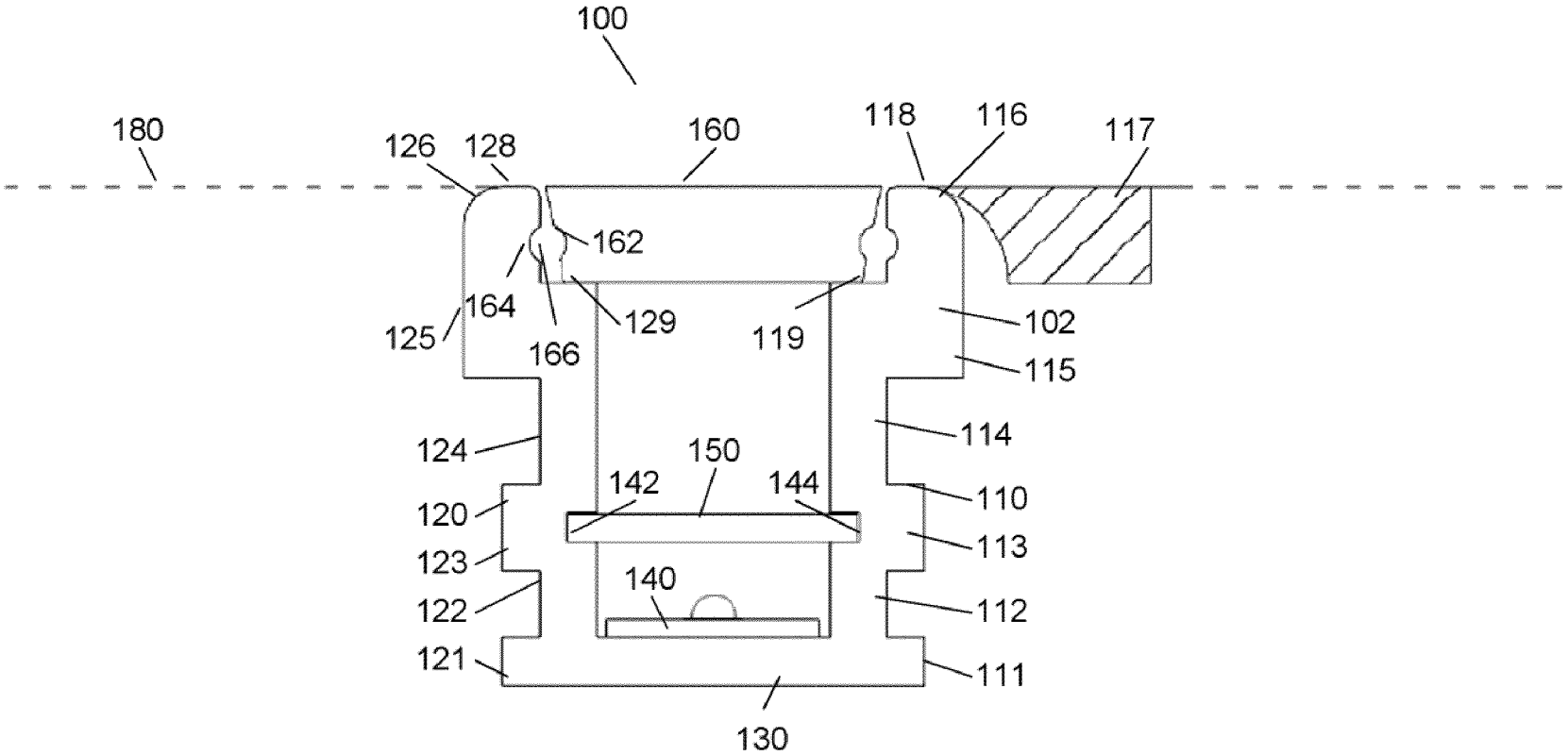
FIG. 1 shows a frontal cross section view of a special purpose LED-based linear lighting apparatus, in accordance with one embodiment of the present invention.

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality. In the drawing like numerals refer to like parts through several views.

The present invention, according to a preferred embodiment, overcomes problems with the prior art by providing a special purpose LED-based lighting apparatus that can be used to illuminate from the ground up so as to illuminate floor and ground areas. This is advantageous as it increases the range of places where the lighting apparatus of the present invention can be used. Also, the present invention can illuminate floor and ground areas from the floor or ground itself, and not from the side or from above, as done conventionally. Furthermore, the construction of the present invention withstands heavy loads and robust strikes or jolts so that automobiles and weighty objects can be placed on top of the LED-based lighting apparatus without damaging it. This is advantageous as it allows for the illumination of heavy-traffic floor areas, such as driveways, that previously could not be illuminated from the driveway itself, but rather from the side.

Additionally, the special purpose LED-based linear lighting apparatus of the present invention is constructed so as to allow the lighting apparatus to be set in concrete, grout or another setting material during construction of a building or a ground area. The present invention includes flanges that grip the concrete in which it is set, thereby allowing the lighting apparatus to be securely locked into place. Also, the present invention includes curved top edges that allow the concrete to project onto the linear lighting apparatus, thereby clutching or grasping the lighting apparatus from below and further securing the apparatus into place in the concrete. Further, the present invention provides a flat top surface that blends in with the surrounding ground or floor after installation, thereby providing a seamless extension of the ground. Lastly, the present invention includes a removable outward face that allows for quick and easy access to the inner working of the lighting apparatus in the event the device requires replacement or repair.

Figure 2:
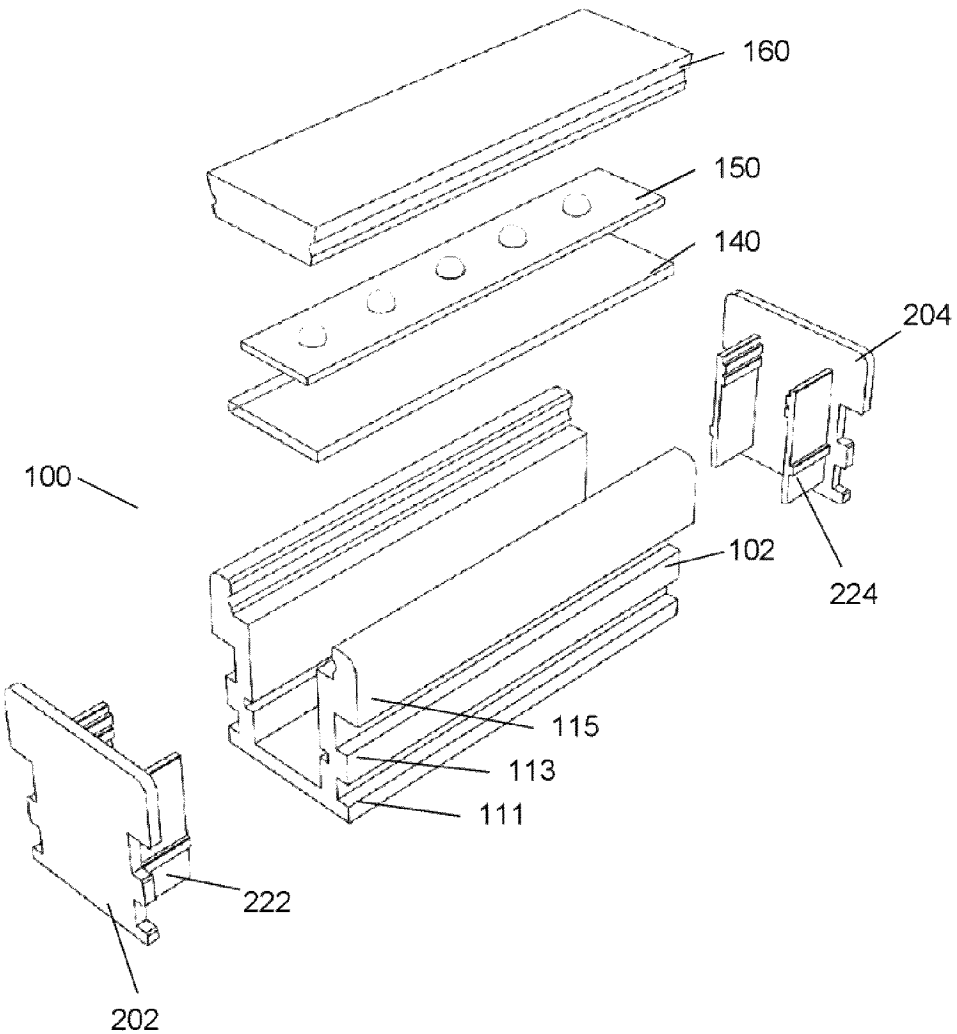
FIG. 2 shows a frontal perspective view of the special purpose LED-based linear lighting apparatus of FIG. 1 in a disassembled state.

The present invention shall be described initially with reference to FIGS. 1 and 2. FIG. 1 shows a frontal cross section view of a special purpose LED-based linear lighting apparatus 100, in accordance with one embodiment of the present invention. FIG. 2 shows a frontal perspective view of the special purpose LED-based linear lighting apparatus 100 of FIG. 1 in a disassembled state.

The apparatus 100 is a linear lighting apparatus using LEDs with the intended function of special purpose lighting for floors and other ground areas. Linear lighting apparatus 100 may be used as a low voltage linear floodlight luminaire for both indoor and outdoor applications. The apparatus 100 exudes light from LEDs in a bottom-up direction to illuminate a floor or ground area from below. The apparatus 100 is constructed for placement into a floor such that the top surface of the apparatus (i.e., the top surfaces of elements 128, 160 and 118) is flush with the floor and thereby provides floor-like functions, such as providing stability, withstanding heavy weight and providing traction. Specifically, the apparatus 100 provides a seamless installation into a floor. Preferably, the apparatus 100 is placed in a floor or ground area and thereafter it is surrounded with concrete, cement or any other setting material comprising the medium for the floor, wherein the top surface of the apparatus 100 remains unobstructed and flush with the floor so as to continue to provide illumination.

FIGS. 1 and 2 show that apparatus 100 comprises an elongated unit 102 of material having a substantially U-shaped cross-section. The unit 102 of apparatus 100 may comprises any of a variety of materials, including aluminum, various alloys, ceramic or plastic. Further, the apparatus 100 may be fabricated using any of a variety of processes, such as extrusion, injection molding, or metal working. In a preferred embodiment, the unit 102 of apparatus 100 comprises extruded aluminum. Unit 102 may be fabricated in a variety of predefined lengths, such as one meter lengths. In addition; unit 102 may be customizable in length.

The substantially U-shaped unit 102 includes a first sidewall 110, a second sidewall 120 and a floor 130. First sidewall 110 shows a bottom flange 111 that runs coplanar with the floor 130 and perpendicular to the sidewall 110. Flange 111 runs coextensive with the unit 102. Note that flange 111 extends laterally outwards from the sidewall 110. This feature of the flange 111 provides lateral stability for the apparatus 100 as the apparatus rests on the bottom surface of the floor 130 and the flange 111. Further, the cavity 112 created between the flange 111 and the flange 113 generates a volume that may be filled with concrete or other setting material when the apparatus 100 is set in place in a floor and surrounded by the setting material, thereby providing a gripping effect on the apparatus 100 and further securing the apparatus 100 in the floor so as to prevent it from being pulled out or tilted.

Flange 113 also runs coextensive with the unit 102. Note that flange 113 extends laterally outwards from the sidewall 110. This feature of the flange 113 provides additional lateral stability for the apparatus 100 as the apparatus 100 rests within concrete or another setting material. Further, the cavity 114 created between the flange 113 and the flange 115 generates a volume that may be filled with concrete or other setting material when the apparatus 100 is set in place in a floor and surrounded by the setting material, thereby providing a gripping effect on the apparatus 100 and further securing the apparatus 100 in the floor so as to prevent it from being pulled out or tilted.

Likewise, flange 115 runs coextensive with the unit 102. Note that flange 115 extends laterally outwards from the sidewall 110, thereby providing additional lateral stability for the apparatus 100 as the apparatus 100 rests within concrete or another setting material. Flange 115 also extends upwards so as to create a flat top surface 118 and an inset top surface 119. Further, the curved top corner 116 of flange 115 creates an opportunity for concrete or another setting material 117 to extend over the top of apparatus 100, even minimally so, thereby providing a gripping effect on the apparatus 100 and further securing the apparatus 100 in the floor so as to prevent it from being pulled out or tilted. Note that flanges 111, 113, and 115 may also act as heat sinks to dissipate the heat that is generated by the LED element 140 within the apparatus 100.

Second sidewall 120 shows a bottom flange 121 that runs coplanar with the floor 130 and perpendicular to the sidewall 120. Flange 121 is constructed similarly to, and performs the same functions as, flange 111. Cavity 122 exists between the flange 121 and the flange 123. Flange 123 also runs coextensive with the unit 102. Flange 123 is constructed similarly to, and performs the same functions as, flange 113. Cavity 124 exists between flange 123 and the flange 125. Flange 125 runs coextensive with the unit 102. Flange 125 is constructed similarly to, and performs the same functions as, flange 115. Flange 125 includes curved top corner 126, a top surface 128 and an inset top surface 129. Note that flanges 121, 123, and 125 may also act as heat sinks to dissipate the heat that is generated by the LED element within the apparatus 100.

The figures show that an LED strip 140, such as a flexible printed circuit board (PCB) strip including a series of LEDs, can rest on the top surface of the floor 130. Strip 140 includes a plurality of LEDs mounted on it. In another embodiment of the present invention, strip 140 comprises a flexible tape with LEDs surface mounted on the tape. A gutter or depression 142 in sidewall 120 and a gutter or depression 144 is sidewall 110 provide a space for the horizontal placement of optical element 150. Gutters 142, 144 may be coextensive with the length of unit 102. Additionally, the inset top surfaces 129 and 119 provide a horizontal resting place for optical element 160.

Optical element 150 is placed inside unit 102 and held in place inside unit 102 by a mechanical, "snap-fit" connection between the optical element 150 and the pair of recesses 142, 144 in unit 102. For example, optical element 150 may be slightly bent by exerting physical pressure along a lateral axis (or perpendicular to a longitudinal axis) of optical element 150. This pressure may cause a lateral size of optical element 150 to decrease in size, thereby allowing optical element 150 to fit inside unit 102 and recesses 142, 144. In other words, the pressure can "squeeze" optical element 150 thereby allowing it to fit within unit 102 and specifically within recesses 142, 144. Once the pressure is removed from primary optical element 150, the elasticity of optical element 150 may cause it to exert outward pressure on walls of unit 102 and recesses 142, 144. The force exerted by optical element 150 outwards towards recesses 142, 144 and the outer walls of unit 102 causes a "snap-fit" connection between optical element 150 and unit 102. Alternatively, optical element 150 may be slid longitudinally into the recesses 142, 144 from a free and open end of unit 102. That is, in this alternative, if an end of apparatus 100 is open, such as shown in FIG. 2, then the optical element 150 may slide into place within the recesses 142, 144.

Optical elements 150, 160 may include refractory materials such as an extruded refractory material. The type of refractory material may differ in each of optical elements 150, 160. In other words, element 150 may comprise a different extruded refractory material than element 160. However, one or both of elements 150, 160 may include the same refractory material. An exemplary material for either one or both of elements 150, 160 may be an acrylic material, due to its excellent light transmission and UV light stability properties. An example of a suitable refractory material for elements 150, 160 is polymethyl methacrylate. However, any refractory material with increased light transmission efficiencies and/or UV light stability properties may be used for elements 150, 160 in accordance with the present invention. Further, optical material with various translucent qualities can be used for either or both elements 150, 160.

In operation, elements 150, 160 act together to refract light emanating from a plurality of single point light sources (the LEDs 140) and thereby increase the light-transmission efficiency of apparatus 100. As an LED produces light, the light enters element 150, which harnesses the light and refracts it so as to direct the light into element 160. For example, element 150 may collimate light emitted from the LEDs 140. Element 150 may allow for total internal reflection of the light entering it, for example. Once light produced by LEDs has been received by element 150 and refracted towards element 160, element 160 then refracts the light again to direct the light in a desired direction. For example, element 160 may be customized to direct light in a 45 degree beam pattern, or spread.

One or more of elements 150, 160 may also provide for inter-reflectance of light emitted by the LEDs 140 so as to mix colors of light emitted by various LEDs. For example, elements 150, 160 may be used to mix different colored light emitted by two or more LEDs or to mix similarly colored light emitted by two or more LEDs to provide a more uniform light emitted by element 160. In addition, one or more of elements 150, 160 may operate alone or together to refract light emitted from the LEDs 140 into a continuous light beam. For example, each LED may provide a single point of light. One or more of elements 150, 160 may refract light from one or more LEDs so as to cause light emitted by element 160 to be continuous and approximately uniform as it emanates from element 160 along a length of apparatus 100.

The combination of elements 150, 160 provide for an efficient linear lighting apparatus 100. As described above, element 150 harnesses light emitted by LEDs 140 so that the amount of light entering element 160 is maximized. Element 160 may then be used to direct, diffuse or refract light in any one of a number of customizable and desired ways. In this way, elements 150, 160 act in series to refract light from LEDs 140 out of element 160.

With regard to element 160, note that the top surface of element 160 is coplanar with the top surface 128 of flange 125, the top surface 118 of flange 115 and the top surface 180 of the surrounding floor, which may comprise concrete or other setting material 117. Considering that the top surface of element 160 is flush with the surrounding floor, the top surface of element 160 (as well as top surface 128 and the top surface 118) acts like an extension of the surrounding floor. Thus, element 160 (as well as top surface 128 and the top surface 118) is comprised of a material that provides floor-like functions, such as providing stability, withstanding heavy weight and providing traction. Further, the placement of element 160 in certain high traffic and high impact areas such as driveways or city sidewalks requires that element 160 withstands heavy loads and robust strikes or jolts so that automobiles and weighty objects can be placed on top of the apparatus 100 without damaging it. Acrylic, for example, of an appropriate make-up, thickness and texture may provide the floor-like functions described above while also meeting the robust criteria for high traffic and high impact areas.

With regard to the structure of element 160, note that the element 160 rests on the top surfaces 129 and 119, such that the placement of weight on top of the element 160 transfers the weight directly onto the sidewalls 110 and 120. Specifically, weight that is placed on element 160 is directed directly vertically downwards onto the two legs of apparatus 100, i.e., sidewalls 110, 120, on to the floor 130 and thereafter on to the floor or ground located under the apparatus 100. In this way, the apparatus 100 efficiently transfers the weight placed upon it to the surrounding floor. Note also, that the width of the bottom surface of element 160 is greater than the width of the gap between the sidewalls 110 and 120. This is so the element 160 cannot be pushed into the gap between the sidewalls 110 and 120 when heavy weight is placed on top of element 160. This is advantageous as it allows the element 160 to be secure in its position even when experiencing heavy loads upon it.

Further note that the combination of the gutter 144 in sidewall 110 with the flange 113 creates a U-shaped interruption in the vertical line of sidewall 110. The result of this U-shaped interruption is the creation of a spring-like feature in sidewall 110. Thus, under a heavy load, the sidewall 110 may compress at the U-shaped feature, so as to absorb certain load forces. This feature is advantageous since it provides a load-bearing capacity to apparatus 100 in addition to the load-bearing capacity of the vertical element 110. Thus, in the presence of a heavy load, the apparatus 100 possesses an additional force reservoir that accepts a certain amount of force before breaking capacity of apparatus 100 is reached. Likewise, gutter 142 in sidewall 120 with the flange 123 creates an identical U-shaped feature that performs the same function as the U-shaped feature in sidewall 110.

FIG. 1 shows that the side surface 162 of the left side of element 160 is angled inwards so that when the side surface 162 is adjacent to the vertical interior side surface 164 of flange 125, a substantially triangle-shaped cavity 166 is created. The purpose of this arrangement is to create a cavity 166 that may be filled with a sealant such as caulk or another rubber based polymer. The sealant provides a seal between element 160 and unit 102 so as to protect the interior volume of the apparatus 100 from moisture, rain, dirt, debris, etc. The cavity 166 provides a volume that may be inhabited by a sealant and create a better water-tight bond between surfaces 162, 164. Note that an identical feature exists on the other (i.e., right) side surface of element 160 and flange 115.

To further the purpose of creating a greater cavity volume for a sealant, note that a semi-circular gutter is gouged both from the side surface 162 of the left side of element 160 and the vertical interior side surface 164 of flange 125. Thus, when side surface 162 of element 160 is adjacent to the vertical interior side surface 164 of flange 125, a substantially circle-shaped cavity is also created (in addition to the already-existing triangle-shaped cavity). The additional cavity provides additional volume that may be inhabited by a sealant and create a better water-tight bond between surfaces 162, 164. Further, the additional rounded cavity created between the surfaces 162, 164 generates a volume that may be filled with sealant when the element 160 is set in place in unit 102 and surrounded by sealant, thereby providing a gripping effect on the element 160 and further securing the element 160 in unit 102 so as to hinder it from being pulled out. Note that an identical feature exists on the other (i.e., right) side surface of element 160 and flange 115.

Another purpose for the triangle shaped cavity 166 is to provide a removable element 160 that allows for quick and easy access to the inner volume of apparatus 100 in the event the device requires replacement or repair, such as a malfunctioning LED strip 140. Note that the sides of element 160 do not touch the interior surfaces of unit 102 such that there is a slight gap between the side surfaces of element 160 and the interior surfaces of unit 102, i.e., a gap between surface 162 and surface 164. Due to the manner in which the element 160 is shaped in relation to the shape of the surrounding unit 102, as well as the horizontal gap between element 160 and unit 102, removal of element 160 to access the interior of apparatus 102 requires only the detachment of the sealant that bonds surfaces 162, 164. This type of detachment can easily be accomplished using a knife with a thin blade, which is inserted into the gap between surfaces 162, 164. Once the bond between surfaces 162, 164 is severed, the element 160 can be easily lifted out, thereby giving easy access to the interior of apparatus 100. After replacement or repair, the element 160 can be easily put back in place and the bond between surfaces 162, 164 can be reattached using a standard sealant. In this manner, the interior of apparatus 100 can be accessed many times with little effort.

FIG. 2 further shows end caps 202 and 204. The end caps 202, 204 are used for capping or sealing the ends of apparatus 100 after assembly. Note that end cap 202 includes a protrusion 222 having the same shape as a portion of the orifice present in the anterior end of unit 102. Thus, the protrusion 222 can be inserted into the anterior end of unit 102 so as to create a friction fit with the unit 102. Likewise, end cap 204 includes a protrusion 224 having the same shape as a portion of the orifice present in the posterior end of unit 102 so that the protrusion 224 can be inserted into the posterior end of unit 102 so as to create a friction fit with the unit 102. Note also that both end caps 202, 204 may include an orifice for allowing an electrical cord or wire to be threaded through the orifice so as to provide power to the LEDs 140.

Figure 3:
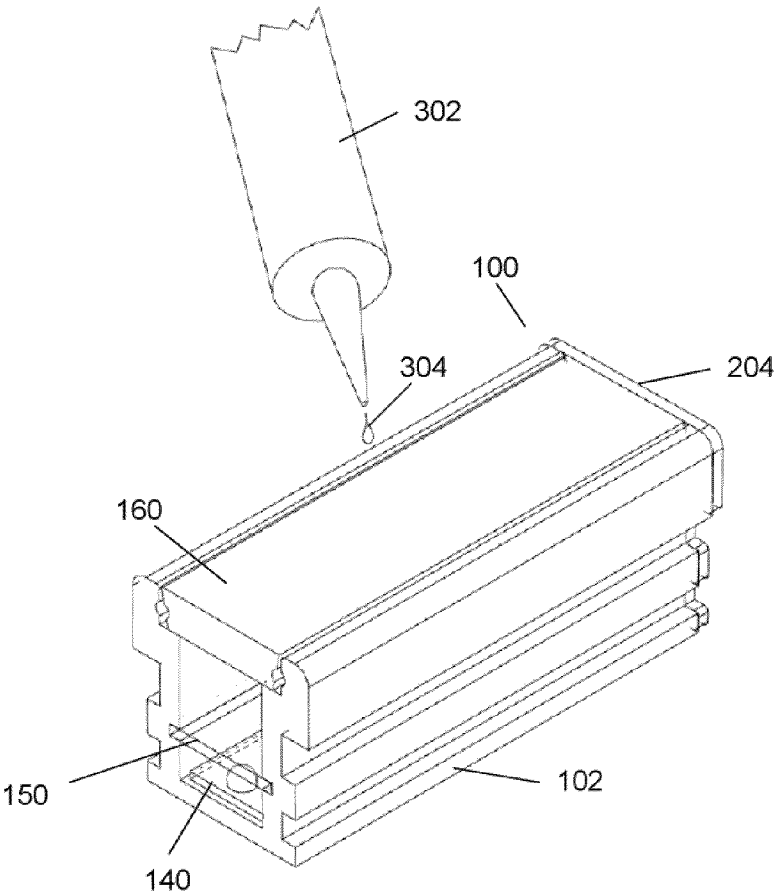
FIG. 3 shows a frontal perspective view of the special purpose LED-based linear lighting apparatus of FIG. 1 in an assembled state.
Figure 4:
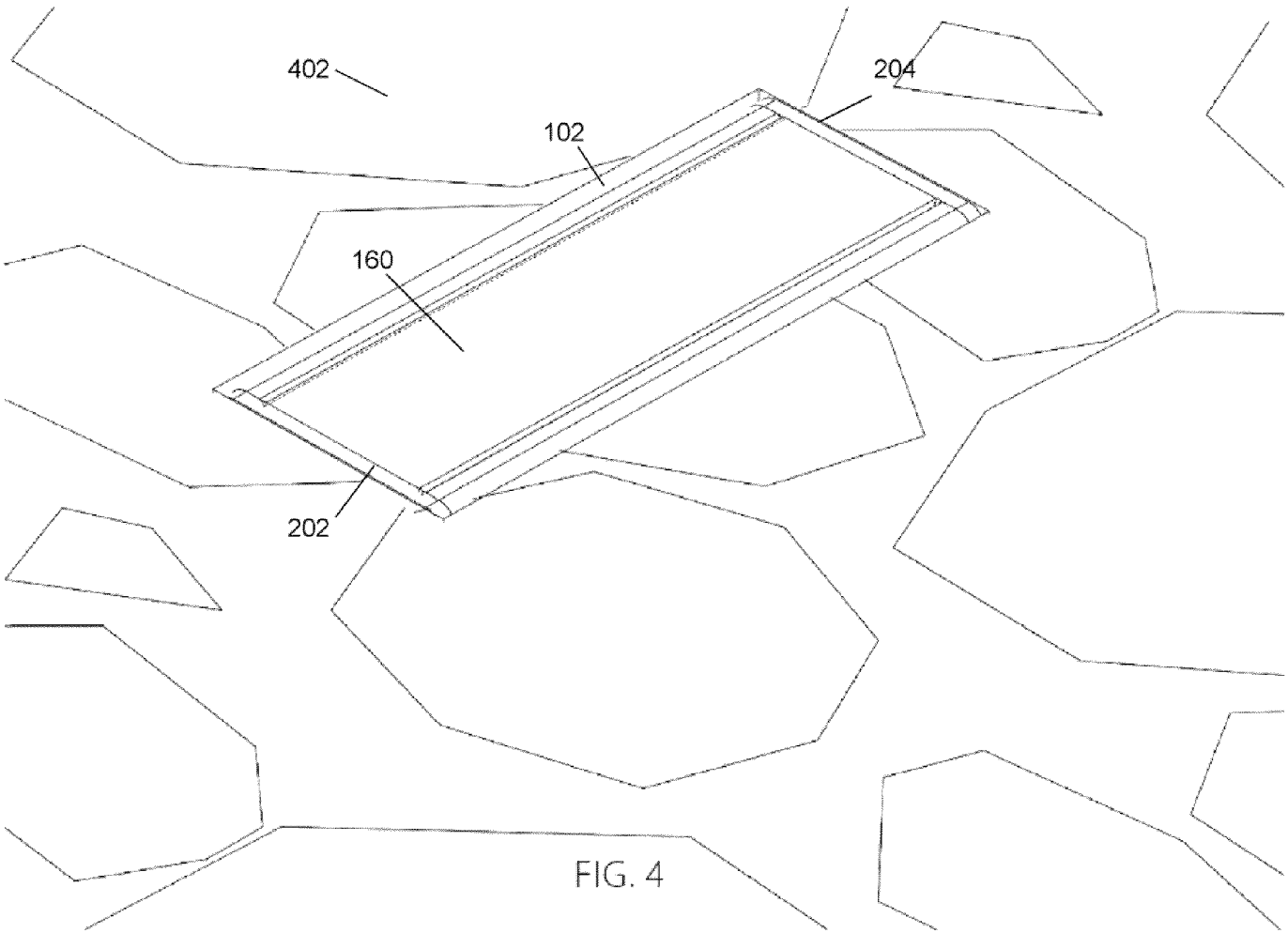
FIG. 4 shows a frontal perspective view of the special purpose LED-based linear lighting apparatus of FIG. 1 after it has been installed in the ground.

FIG. 3 shows a frontal perspective view of the special purpose LED-based linear lighting apparatus 100 of FIG. 1 in an assembled state. Note that FIG. 3 shows end cap 204 having been coupled with unit 102. FIG. 3 also shows a sealant dispenser 302 dispensing a sealant 304 into the gap between the side surface of element 160 and the interior surface of unit 102, i.e., the gap between surface 162 and surface 164. FIG. 4 shows a frontal perspective view of the special purpose LED-based linear lighting apparatus 100 of FIG. 1 after it has been installed in the ground 402. FIG. 4 shows that the top surface of element 160 is flush with the floor 402, as well as the top surfaces of unit 102 and end caps 202, 204.

Figure 5:
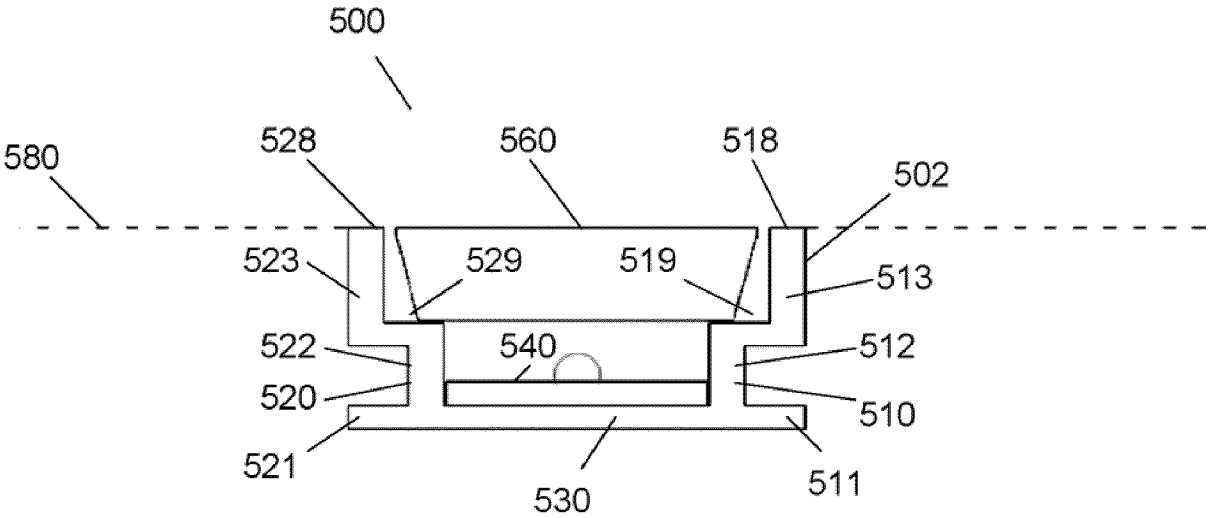
FIG. 5 shows a frontal cross section view of an alternative special purpose LED-based linear lighting apparatus, in accordance with one embodiment of the present invention.
Figure 6:
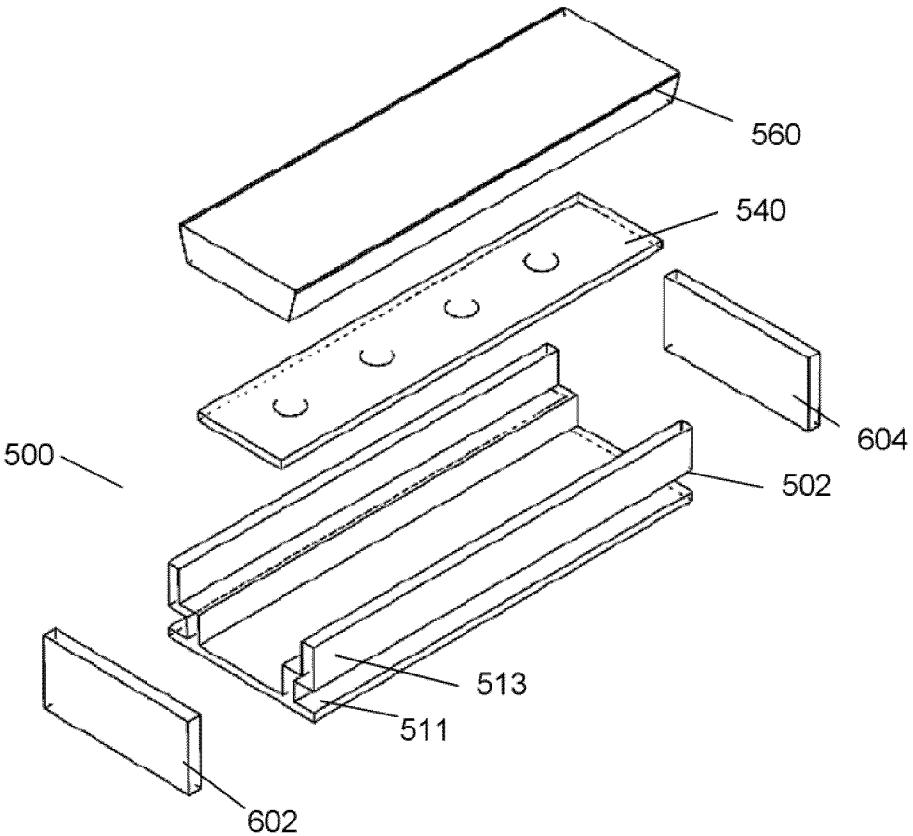
FIG. 6 shows a frontal perspective view of the alternative special purpose LED-based linear lighting apparatus of FIG. 5 in a disassembled state.

An alternative embodiment of the present invention shall be described below with reference to FIGS. 5 and 6. FIG. 5 shows a frontal cross section view of an alternative special purpose LED-based linear lighting apparatus 500, in accordance with one embodiment of the present invention. FIG. 6 shows a frontal perspective view of the alternative special purpose LED-based linear lighting apparatus 500 of FIG. 5 in a disassembled state.

The apparatus 500 is a linear lighting apparatus using LEDs with the intended function of special purpose lighting for interior floors or walls. Linear lighting apparatus 500 may be used as a low voltage linear floodlight luminaire for indoor applications. The apparatus 500 may exude light from LEDs in a bottom-up direction to illuminate a floor or ground area from below or in a side-to-side direction to illuminate a wall or ground area from the side. The apparatus 500 is constructed for placement into a floor or a wall such that the top surface of the apparatus (i.e., the top surfaces of elements 528, 560 and 518) is flush with the floor or wall. If used on the floor, the apparatus 500 provides floor-like functions, such as providing stability, withstanding standard indoor weight and providing traction. The apparatus 500 provides a seamless integration with a floor or wall. Preferably, the apparatus 500 is placed in a floor or in a wall and thereafter it is surrounded with grout, concrete, cement or any other setting material comprising the medium for the floor or the wall, wherein the top surface of the apparatus 500 remains unobstructed and flush with the floor or wall so as to continue to provide illumination.

FIGS. 5 and 6 show that apparatus 500 comprises an elongated unit 502 of material having a substantially U-shaped cross-section, wherein the unit 502 is similar in composition and construction to unit 102. The substantially U-shaped unit 502 includes a first sidewall 510 (similar to sidewall 110), a second sidewall 520 (similar to sidewall 120) and a floor 530. First sidewall 510 shows a bottom flange 511 that runs coplanar with the floor 530 and perpendicular to the sidewall 510. Flange 511 runs coextensive with the unit 502. Note that flange 511 extends laterally outwards from the sidewall 510 and possesses similar features and functions as flange 111. Further, the cavity 512 created between the flange 511 and the flange 513 possesses the same functions as cavity 112.

Flange 513 runs coextensive with the unit 502. Note that flange 513 extends laterally outwards from the sidewall 510 and possesses similar features and functions as flange 115. Flange 513 also extends upwards so as to create a top surface 518 and an inset top surface 519. FIGS. 5 and 6 also show flange 521, cavity 522, flange 523, and horizontal surfaces 528, 529, on sidewall 520, all of which are similar to their counterparts on sidewall 510.

LED strip 540 can rest on the top surface of the floor 530. Optical element 560 rests on top of surfaces 529, 519 and may include the same or similar composition and functionality as optical elements 150, 160. With regard to the structure of element 102, note that the element 560 rests on the top surfaces 529 and 519, such that the placement of weight on top of the element 560 transfers the weight directly onto the sidewalls 510 and 520. Specifically, weight that is placed on element 560 is directed directly downwards and vertically onto the two legs of apparatus 500, i.e., sidewalls 510, 520, on to the floor 530 and thereafter on to the floor or wall located under the apparatus 500. In this way, the apparatus 500 efficiently transfers the weight placed upon it to the surrounding floor or wall.

FIGS. 5 and 6 shows that, much like element 160, the side surface of element 560 is angled inwards so that when the side surface is adjacent to the vertical interior side surface of flange 513, a substantially triangle-shaped cavity is created. The purpose of this cavity is as described above for cavity 166 with reference to FIGS. 1 and 2, i.e., for better sealant properties and for providing easy access to the interior of apparatus 500.

With regard to element 560, note that the top surface of element 560 is coplanar with the top surface 528 of flange 523, the top surface 518 of flange 513 and the top surface 580 of the surrounding floor or wall, which may comprise concrete, tile or other setting material. Considering that the top surface of element 560 is flush with the surrounding floor or wall, the top surface of element 560 (as well as top surface 528 and the top surface 518) acts like an extension of the surrounding floor or wall. Thus, element 560 may be comprised of a material that provides floor-like or wall-like functions, such as providing stability, withstanding heavy weight and providing traction.

Further note that the combination of the cavity 512 with sidewall 510 creates a U-shaped interruption in the vertical line of sidewall 510. The result of this U-shaped interruption is the creation of a spring-like feature in sidewall 510, similar to the spring-like feature in sidewall 110. Likewise, cavity 522 with sidewall 520 creates an identical U-shaped feature that performs the same function as the U-shaped feature in sidewall 120. Note also the presence of end caps 602, 604, similar in structure and function to end caps 202, 204.

Figure 7:
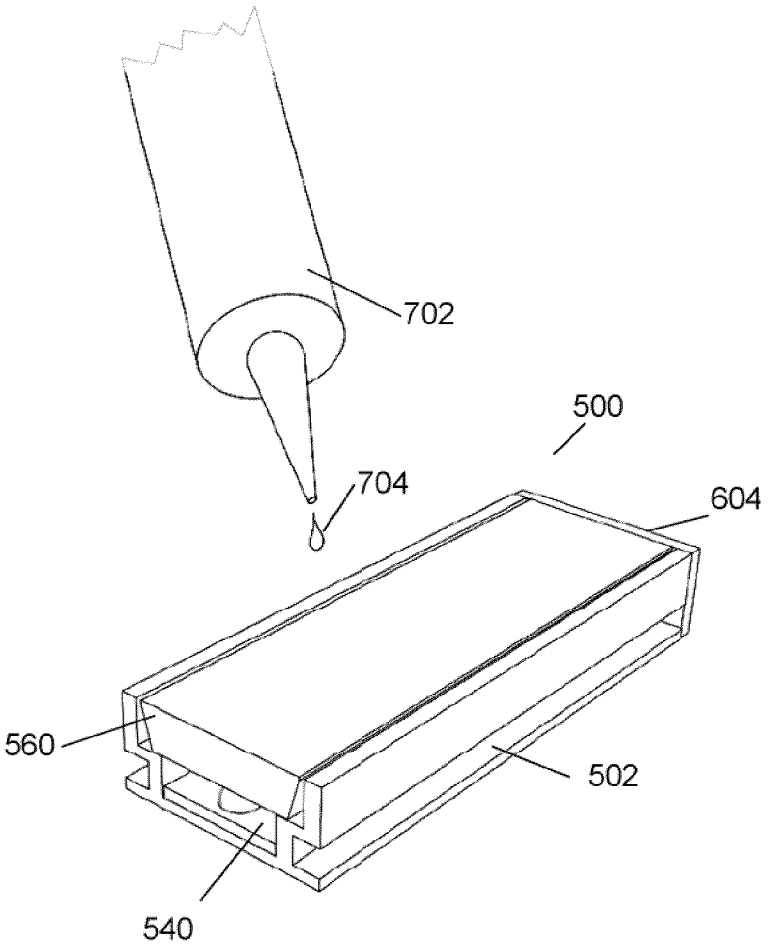
FIG. 7 shows a frontal perspective view of the alternative special purpose LED-based linear lighting apparatus of FIG. 5 in an assembled state.

FIG. 7 shows a frontal perspective view of the alternative special purpose LED-based linear lighting apparatus 500 of FIG. 5 in an assembled state. FIG. 7 also shows a sealant dispenser 702 dispensing a sealant 704 into the gap between the side surface of element 560 and the interior surface of unit 502.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. A linear lighting apparatus, comprising:

an elongated element having a substantially U-shaped cross-section comprising a first vertical sidewall, a second vertical sidewall and a horizontal floor joining the first and second sidewalls;

an LED strip placed longitudinally along the horizontal floor of the elongated element;

a first pair of flanges located on exterior surfaces of the first and second sidewalls, wherein the first pair of flanges is coextensive with the elongated element and coplanar with the horizontal floor;

a second pair of flanges located on exterior surfaces of the first and second sidewalls, wherein the second pair of flanges is coextensive with the elongated element and parallel to the horizontal floor;

a pair of gutters located on interior surfaces of the first and second sidewalls, wherein the pair of gutters is coplanar with the second pair of flanges so as to form a U-shaped protrusion on the exterior surfaces of the first and second sidewalls, thereby comprising the second pair of flanges;

a first rim located on a top of the first sidewall, wherein the first rim comprises a horizontal surface adjacent to a vertical surface extending upwards from the horizontal surface;

a second rim located on a top of the second sidewall, wherein the second rim comprises a horizontal surface adjacent to a vertical surface extending upwards from the horizontal surface; and a second optical element comprising an elongated planar element for placement on top of the horizontal surface of the first rim and the horizontal surface of the second rim, wherein both sides of the second optical element are adjacent to the vertical surface of the first rim and the vertical surface of the second rim.

2. The linear lighting apparatus of claim 1, wherein both sides of the second optical element angle towards a central axis of the elongated element so as to create a cavity on both sides of the second optical element at a junction between both sides of the second optical element and the first and second rims.

3. The linear lighting apparatus of claim 2, wherein both sides of the second optical element include semi-circular shaped gutters coextensive with the second optical element so as to create an additional cavity on both sides of the second optical element at the junction between both sides of the second optical element and the first and second rims.

4. The linear lighting apparatus of claim 3, wherein the vertical surface of the first rim and the vertical surface of the second rim include semi-circular shaped gutters coextensive with the elongated element so as to create an additional cavity on both sides of the second optical element at the junction between both sides of the second optical element and the first and second rims.

5. The linear lighting apparatus of claim 4, wherein an outer edge of a top of the vertical surface of the first rim and an outer edge of a top of the vertical surface of the second rim are rounded.

6. The linear lighting apparatus of claim 5, further comprising a pair of cavities in the exterior surfaces of the first and second sidewalls located between the first pair of flanges and the second pair of flanges.

7. The linear lighting apparatus of claim 6, further comprising a pair of cavities in the exterior surfaces of the first and second sidewalls located between the second pair of flanges and the first and second rims.

8. A linear lighting apparatus, comprising:

an elongated element having a substantially U-shaped cross-section comprising a first vertical sidewall, a second vertical sidewall and a horizontal floor joining the first and second sidewalls;

an LED strip placed longitudinally along the horizontal floor of the elongated element;

a first pair of flanges located on exterior surfaces of the first and second sidewalls, wherein the first pair of flanges is coextensive with the elongated element;

a first optical element comprising an elongated planar element composed of optical material, wherein the first optical element is positioned within the elongated element parallel to the horizontal floor;

a first rim located on a top of the first sidewall, wherein the first rim comprises a horizontal surface adjacent to a vertical surface extending upwards from the horizontal surface;

a second rim located on a top of the second sidewall, wherein the second rim comprises a horizontal surface adjacent to a vertical surface extending upwards from the horizontal surface; and a second optical element comprising an elongated planar element for placement on top of the horizontal surface of the first rim and the horizontal surface of the second rim, wherein the sides of the second optical element are adjacent to the vertical surface of the first rim and the vertical surface of the second rim.

9. The linear lighting apparatus of claim 8, wherein both sides of the second optical element angle towards a central axis of the elongated element so as to create a cavity on both sides of the second optical element at a junction between both sides of the second optical element and the first and second rims.

10. The linear lighting apparatus of claim 9, wherein both sides of the second optical element include semi-circular shaped gutters coextensive with the second optical element so as to create an additional cavity on both sides of the second optical element at the junction between both sides of the second optical element and the first and second rims.

11. The linear lighting apparatus of claim 10, wherein the vertical surface of the first rim and the vertical surface of the second rim include semi-circular shaped gutters coextensive with the elongated element so as to create an additional cavity on both sides of the second optical element at the junction between both sides of the second optical element and the first and second rims.

12. The linear lighting apparatus of claim 11, wherein an outer edge of a top of the vertical surface of the first rim and an outer edge of a top of the vertical surface of the second rim are rounded.

13. The linear lighting apparatus of claim 12, further comprising a pair of cavities in the exterior surfaces of the first and second sidewalls located between the first pair of flanges and a second pair of flanges.

14. The linear lighting apparatus of claim 13, further comprising a pair of cavities in the exterior surfaces of the first and second sidewalls located between the second pair of flanges and the first and second rims.

15. A linear lighting apparatus, comprising:

an elongated element having a substantially U-shaped cross-section comprising a first vertical sidewall, a second vertical sidewall and a horizontal floor joining the first and second sidewalls;

an LED strip placed longitudinally along a bottom of the elongated element;

a first pair of flanges located on exterior surfaces of the first and second vertical sidewalls, wherein the first pair of flanges is coextensive with the elongated element and coplanar with the horizontal floor;

a first horizontal surface located on a top of the first vertical sidewall;

a first vertical surface extending upwards from the first horizontal surface;

a second horizontal surface located on a top of the second vertical sidewall;

a second vertical surface extending upwards from the second horizontal surface;

an optical element comprising an elongated planar element for placement on top of the first and second horizontal surfaces, wherein the sides of the optical element are adjacent to the first and second vertical surfaces, wherein both sides of the optical element angle towards a central axis of the elongated element so as to create a cavity on both sides of the optical element at a junction between both sides of the optical element and the first and second vertical surfaces.

16. The linear lighting apparatus of claim 15, wherein both sides of the optical element include semi-circular shaped gutters coextensive with the optical element so as to create an additional cavity on both sides of the optical element at the junction between both sides of the optical element and the first and second vertical surfaces.

17. The linear lighting apparatus of claim 16, wherein the first and second vertical surfaces include semi-circular shaped gutters coextensive with the elongated element so as to create an additional cavity on both sides of the optical element at the junction between both sides of the optical element and the first and second vertical surfaces.

18. The linear lighting apparatus of claim 17, wherein an outer edge of a top of the first and second vertical surfaces is rounded.

19. The linear lighting apparatus of claim 18, further comprising a pair of cavities in the exterior surfaces of the first and second sidewalls located between the first pair of flanges and the first and second horizontal surfaces.

* * * * *